United States Patent [19]

Folsberg

[11] Patent Number: 4,511,462

[45] Date of Patent: Apr. 16, 1985

[54] METHOD AND APPARATUS FOR SORTING PARTICULATE MATERIAL

[75] Inventor: Jan Folsberg, Copenhagen, Denmark

[73] Assignee: F. L. Smidth & Co., Cresskill, N.J.

[21] Appl. No.: 410,638

[22] Filed: Aug. 23, 1982

[30] Foreign Application Priority Data

Sep. 1, 1981 [GB] United Kingdom ..... 8126461

[51] Int. Cl.[3] ..... B07B 7/083

[52] U.S. Cl. ..... 209/140; 209/138; 209/144

[58] Field of Search ..... 209/143, 144, 148, 153, 209/139 A, 138, 141, 145, 140

[56] References Cited

U.S. PATENT DOCUMENTS

| | | | |
|---|---|---|---|
| 667,573 | 2/1901 | Pfeiffer | 209/148 |
| 826,772 | 7/1906 | Emerick | 209/139.2 |
| 1,457,110 | 4/1921 | Gay | 209/144 |
| 1,756,960 | 3/1928 | Stebbins | 209/144 |
| 1,876,516 | 9/1924 | Fraser | 209/139.2 |

FOREIGN PATENT DOCUMENTS

| | | | |
|---|---|---|---|
| 472882 | 12/1914 | France | 209/139.2 |

*Primary Examiner*—Frank W. Lutter
*Assistant Examiner*—William Bond
*Attorney, Agent, or Firm*—Pennie & Edmonds

[57] ABSTRACT

A method for separating particulate material into coarse and fine fractions is disclosed by suspending the material in a conveying gas flow having a radially symmetrical flow pattern, radially surrounding the gas suspension with a band of clean gas containing substantially no particulate and directing the concentric gas flow past a vaned rotating rotor having an axis of rotation axially aligned with the concentric axis of the gases. The rotor vanes fling the coarse fraction in a radially outwardly direction while the remaining fine fraction remains in the conveying gas flow for subsequent separation from the gas. An apparatus in the form of a separator is disclosed for sorting particulate material suspended within a conveying gas into coarse and fine fractions is also disclosed. The separator has a radially symmetrical wall for flow of conveying gas suspension therethrough, a vaned rotatable rotor axially aligned within the wall and means defining an annular chamber between itself and the wall for flow of a band of clean gas so that the clean gas radially surrounds the conveying gas.

8 Claims, 5 Drawing Figures

METHOD AND APPARATUS FOR SORTING PARTICULATE MATERIAL

BACKGROUND OF THE INVENTION

1. Field of the Invention

This invention relates to a method and apparatus for sorting a particulate material into coarse and fine fractions.

2. Description of the Prior Art

In the past, separators have been developed of the type having a vertical, rotationally symmetrical, preferably cylindrically shaped separator wall, and a vane rotating therein about the cylindrical axis. In such a separator, the material is suspended in a vertically ascending conveying gas that is conveyed past the rotating vane. Centrifugal force generated by the rotating vane flings the coarser fraction of the material in a radially outwardly direction toward the wall, to be passed down towards the bottom and out of the separator. The finer fraction of the material is passed on upwards by the conveying gas to be subsequently separated from the gas.

As a result of this separating method and apparatus, the fine fraction practically comprises all of the grains in the suspension that are below a predetermined smaller first grain size, and the coarse fraction practically comprises all of the grains that are above a predetermined second larger grain size. An intermediate fraction comprising grain sizes between the said first and second grain sizes is present both in the fine and the coarse fraction at an increasing percentage of larger and larger grains in the coarse fraction and a correspondingly declining percentage in the fine fraction. This distribution of the intermediate fraction in the fine and the coarse fraction respectively, is due to the fact that the centrifugal forces acting upon the grains as a consequence of the rotary vane are different dependant upon the position of the grains in the suspension in relation to the axis of rotation. The tendency of the grains in the intermediate fraction to being sorted to the coarse fraction will thus increase the larger the distance from the axis of rotation when they reach the vane.

In principle the size of the difference between the above first and second grain sizes expresses the separator's sorting capability or separation sharpness. The smaller this difference, the better the separation sharpness, and the better the separation of the suspension into two fractions.

I have invented a method and apparatus in which the separation sharpness of the above described technique is vastly improved. According to the invention this is achieved by providing a band of clean conveying gas extending annularly around the suspension gas flow within the separator.

SUMMARY OF THE INVENTION

A method of separating particulate material into coarse and fine fractions is disclosed comprising, suspending the material in a conveying gas flow, directing the conveying gas suspension through means having a generally radially symmetrical opening, concentrically surrounding the gas suspension with a band of clean gas containing substantially no particulate, causing the coarser fraction to be flung in a radially outward direction, and directing the remaining finer fraction in the gas flow past the rotor for subsequent separation from the gas.

In a preferred embodiment, the method for separating particulate material into coarse and fine fractions is carried out in conjunction with a separator having a rotationally symmetrical wall and a vaned rotor rotatable inside the wall about the axis of symmetry, comprising, suspending the material in a conveying gas flow, directing the conveying gas suspension through the separator in a radially symmetrical flow pattern, concentrically surrounding the gas suspension with a band of clean gas containing substantially no particulate, directing the conveying gas flow past the vaned rotating rotor having an axis of rotation axially aligned with the concentric axis of the gases, flinging the coarser fraction in a radially outward direction by action of the vaned rotor, and directing the remaining finer fraction in the gas flow past the rotor for subsequent separation from the gas.

The invention also relates to an apparatus for sorting particulate material suspended within a conveying gas flow into coarse and fine fractions comprising, a radially symmetrical wall for fow of conveying gas suspension therethrough, a vaned rotatable rotor axially aligned inside the wall, and means defining an annular chamber within the wall for flow of a band of clean gas containing substantially no particulate, the clean gas surrounding the suspension gas such that the rotating rotor causes the coarser fraction to be flung in a radially outwardly direction and the finer fraction remains suspended in the conveying gas for subsequent separation.

In a preferred form, the apparatus for sorting particulate material into coarse and fine fractions comprises a rotationally symmetrical wall and a vaned rotor rotatable inside the wall about the axis of symmetry, in which the material is suspended in a gas flow and is conveyed past the rotor, by means of which the coarser fraction of the material is flung radially outwardly towards the wall, the finer fraction of the material remaining suspended in the conveying gas to be subsequently separated from the gas, and means defining an annular chamber coaxial with the wall through which clean gas can be passed for providing an annular band of clean conveying gas around the rotor.

Thus, it will be appreciated that a feature of the present invention relates to the provision of a band of clean conveying gas extending annularly around the suspension gas flow within the separator, thus improving the separation sharpness of the technique.

Calculations have shown that for a separator according to the invention in which the velocity of the aggregate amount of conveying gas supplied is unchanged, but in which some of the conveying gas constitutes a band of clean gas as stated above, a significant improvement of the separation sharpness of the separator is obtained, i.e., a smaller difference between the above first and second grain sizes.

Thus as will be seen in further detail hereinbelow, the invention also relates to an apparatus in the form of a separator for carrying out the method according to the invention, the separator having means forming an annular chamber co-axial with the separator wall through which clean gas can be passed to provide an annular band of clean conveying gas around the rotor. As will be seen further, such a separator may be constructed in various forms.

In one embodiment the separator has an inlet in its bottom for admission of a suspension formed outside the separator, and the annular chamber may be defined by an inlet pipe for the material suspension, encircled by an inlet pipe for clean conveying gas.

In another embodiment, the separator has a distributing disc rotating about the separator axis disposed below the rotating vane for collecting unsorted material and dispersing it into the ascending conveying gas flow. The annular chamber may be defined by a shield positioned at substantially the same level as the distributing disc.

BRIEF DESCRIPTION OF THE DRAWINGS

Preferred embodiments of the invention are described hereinbelow with reference to the drawings, wherein.

DESCRIPTION OF THE PREFERRED EMBODIMENTS

Figure 1:
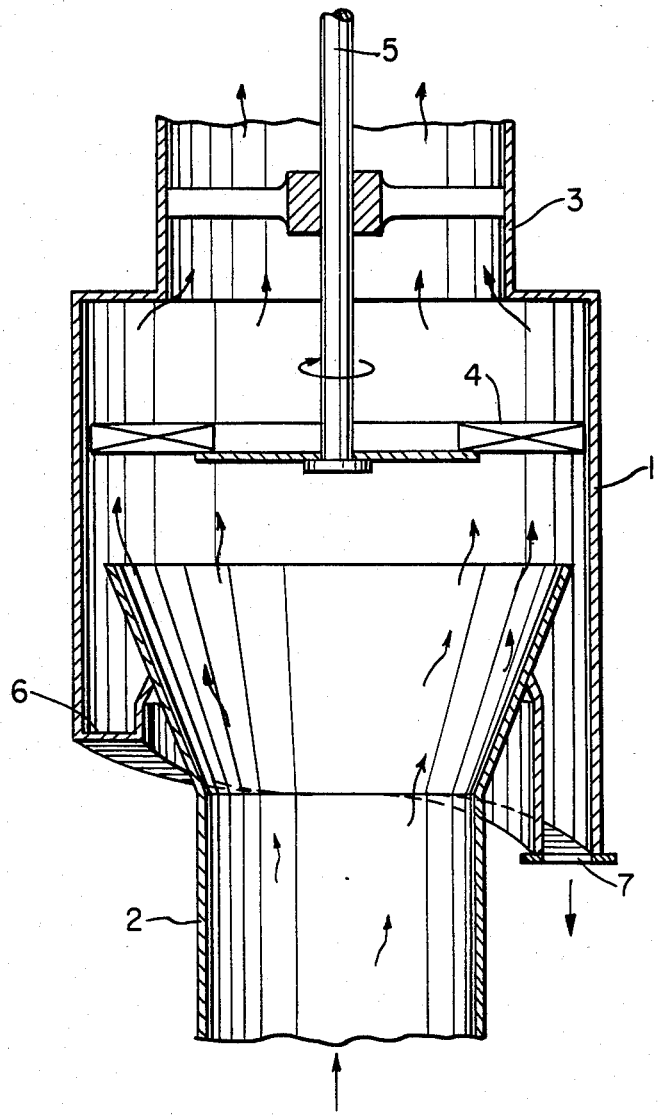
FIG. 1 PRIOR ART
FIG. 1 is an elevational view, partially in cross-section, of a known separator.
Figure 2:
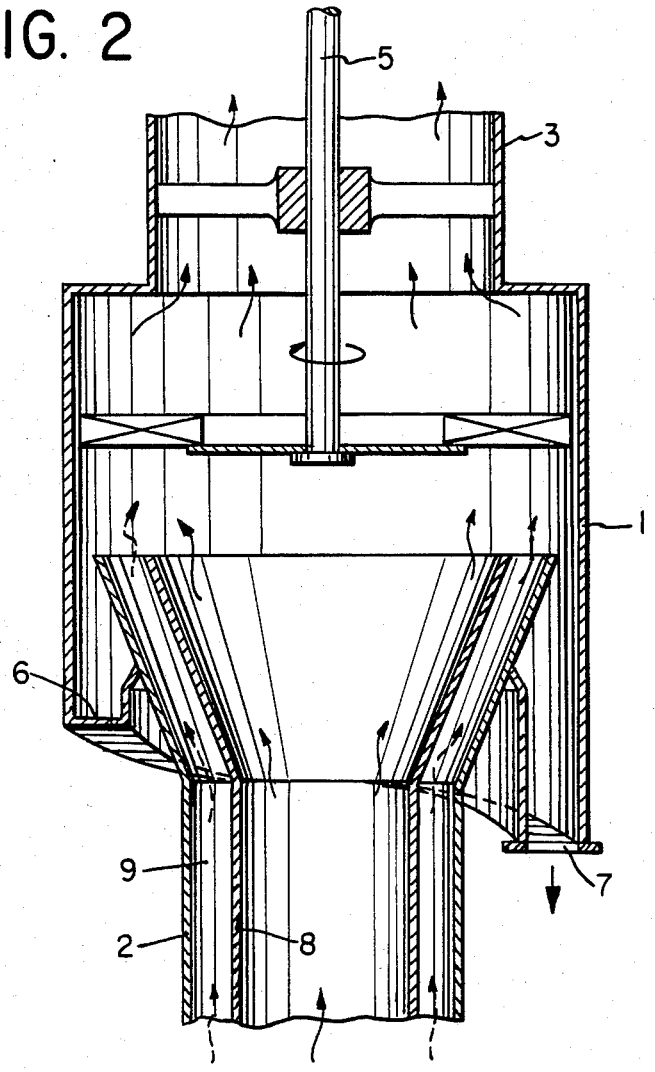
FIG. 2 is an elevational view, partially in cross-section, similar to that of FIG. 1 of a separator constructed in accordance with the teachings of the present invention.

Referring to the drawings, FIGS. 1 and 2 show separators which separate a pre-suspended material and gas mixture. FIG. 1 shows a known embodiment of a separator comprising a housing having a cylindrical wall 1, an inlet pipe 2 exclusively for unseparated particulate material suspended in a conveying gas flow, and an outlet 3 for the fine fraction that remains suspended in the gas.

Inside the housing 1 is a rotatable rotor having a number of vanes 4. The rotor is mounted on a shaft 5 which is concentrically aligned with the cylindrical axis of the separator wall 1.

At the bottom of the housing is a chute 6 for collection of the coarse fraction separated from the material. The chute slopes downwardly towards a coarse fraction outlet 7. In the chute 6 is fluidizing means (not shown), e.g. a perforated compressed air pipe, for fluidizing the material in the chute to make it flow down towards the outlet 7 and out of the separator.

Material suspended in the conveying gas flows in an upwardly direction in the separator across the entire cross-section of inlet tube 2. Vane 4 imparts a cyclone-like movement to the suspension as it passes the vane. The cyclone-like movement produces centrifugal forces on the individual grains which flings them towards the cylinder wall 1.

All grains above a predetermined size will reach the cylinder wall 1 before the conveying gas suspending those grains leaves the separation chamber through the outlet 3. However, all grains below a different predetermined size will not reach the cylinder wall 1 before the conveying gas suspending them reaches the outlet 3; they are therefore discharged from the separator and subsequently separated from the conveying gas, e.g., by means of a cyclone separator.

Some of the medium sized grains will be separated in the separator together with the coarser grain fraction whereas others will leave the separator with the finer grain fraction. Into which fraction a particular intermediate grain is separated depends upon the magnitude of centrifugal force acting upon it (i.e., the distance from the axis of rotation) and the grain size.

FIG. 2 shows a separator which is constructed in accordance with the teachings of the invention wherein an inlet pipe 8 is disposed inside, and coaxially with, the inlet pipe 2. A material-gas suspension is admitted into the separator through inlet pipe 8 alone and clean gas (without entrained material), such as clean conveying gas, is admitted through the annular duct or chamber 9 formed between the inlet pipes 2 and 8 at the same velocity as that of the suspension gas.

Thus a band of clean gas, such as clean conveying gas (e.g. air), encircles the material-gas suspension along the cylinder wall 1. The clean gas band restricts suspension fow, barring the finer intermediate-sized grains from reaching the wall of the separation chamber. This improves the sorting capacity or separation sharpness of the separator.

Figure 3:
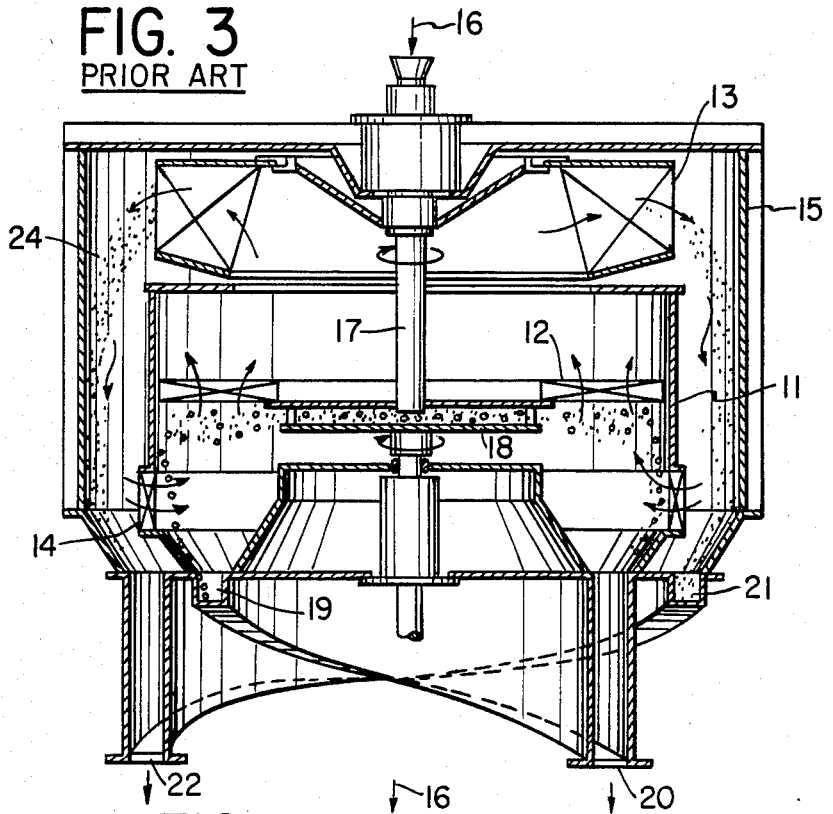
FIG. 3 PRIOR ART
FIG. 3 is an elevational view, partially in cross-section, of a second type of known separator.
Figure 4:
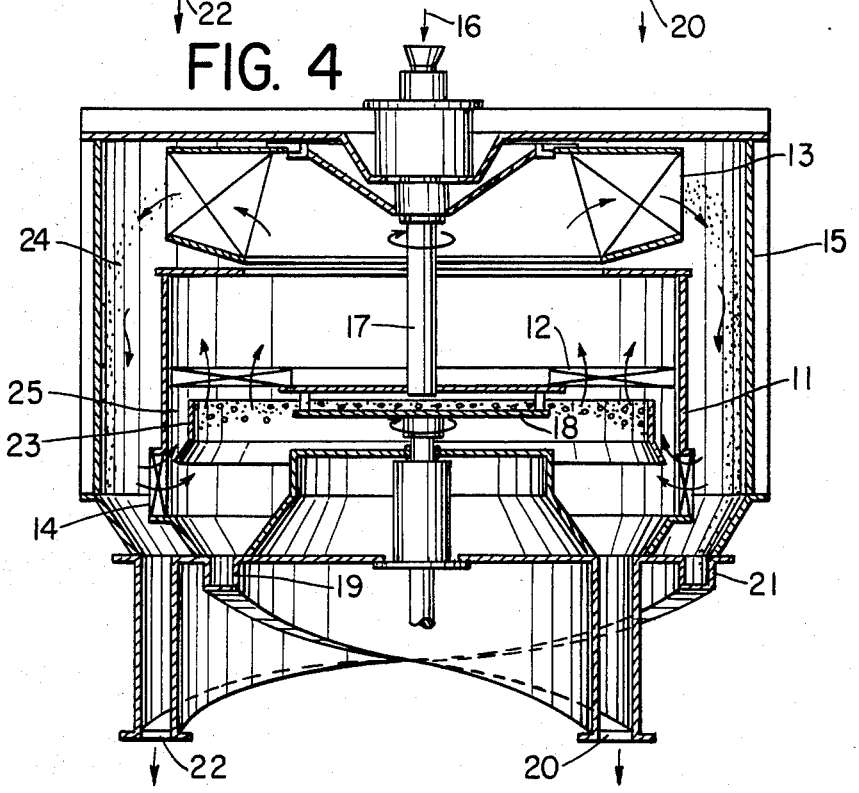
FIG. 4 is an elevational view, partially in cross-section, similar to that of FIG. 3 of a separator constructed in accordance with the teachings of the present invention.

While the separators in FIGS. 1 and 2 are supplied with material-gas suspension from outside, FIGS. 3 and 4 show separator types in which the suspension of the material is brought about within the separator proper.

The separator shown in FIG. 3 is a known design having a cylinder wall 11 and rotatable vanes 12. A conveying gas flow is created in a known manner by fan 13. The gas flows downwardly outside cylinder wall 11 as indicated by arrows from 13 to guide vanes 14. Guide vanes 14 direct the gas in an upwardly direction inside wall 11 through the separation chamber. The entire system is encased by a closed housing 15.

Unseparated particulate material is introduced into the separator from above, as indicated by arrow 16, and down through the hollow shaft 17 of the fan 13 to a rotary distributing disc 18. The disc 18 distributes the material across the entire ascending conveying gas flow. The suspension thus created is sorted in the separation chamber into coarse and fine fractions. The coarse fraction flows alongside the wall 11 to a chute 19 and flows in a fluidized state to a coarse fraction outlet 20. The remaining fine fraction leaves the separation chamber at its top, entrained in the conveying gas, and passes into the annular chamber 24 between the cylinder wall 11 and the housing 15 and is passed down along the wall 11 of the housing to a chute 21 from which it is discharged via the outlet 22.

FIG. 4 shows a separator similar to that of FIG. 3 constructed in accordance with the teachings of the present invention. An annular shield 23 encircles the distributing disc 18, spaced from it by a given radial distance. The shield radially confines the spreading of the material supplied through the hollow shaft 17 in the ascending gas flow and its distribution by the distributing disc 18. The shield 23 thus creates an annular chamber for maintenance of a clean gas band 25 along the cylinder wall, the effect of which is the same as that provided in the separator shown in FIG. 2.

Figure 5:
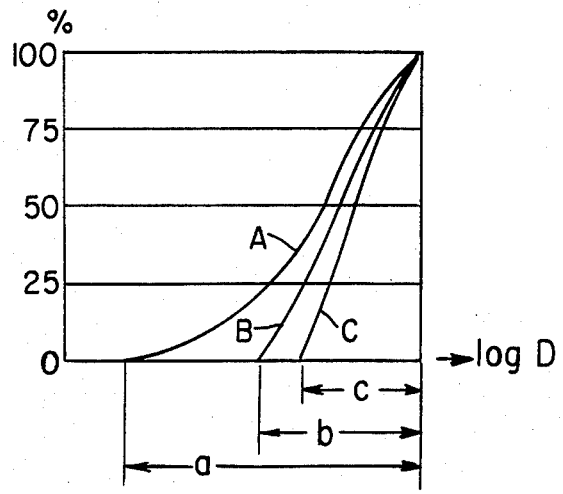
FIG. 5 is a graph indicating the sorting capability of known separators and those of the present invention.

The distribution of the medium size grains partly in the coarse grain fraction and partly in the fine grain fraction is dependant on the grain size and the radial distance from the separator vane's axis of rotation as illustrated by the curve "A" in FIG. 5. The graph's ordinate (vertical) axis shows the percentage of the individual grain sizes separated off in the separator as a coarse fraction. The abscissa (horizontal) axis is a logarithmic scale of the grain size.

The grain size range "a" illustrates the so-called intermediate fraction being distributed between the fine and the coarse fraction, and shows the sorting capability or separation sharpness of the separator.

The curve "A" is representative of a separator of a known type such as shown in FIG. 1 or 3, operating under certain conditions with regard to gas velocity, rotational speed of the vane 4 or 12, etc.

The two curves "B" and "C" corresond to the curve "A", and relate to a separator operating under the same conditions as before, i.e., at the same velocity of the aggregate amount of conveying gas and at the same rotational speed of the vane 4 or 12, but now equipped with means for providing a clean gas band extending around the suspension fow, i.e., the inlet pipe 8 in FIG. 2 or the shield 23 in FIG. 4.

The curves "B" and "C" relate to the ratio between the diameter of the suspension gas flow in a separator constructed according to the invention having a clean gas band, and the diameter of the suspension gas flow in the corresponding known separator without a clean gas band. The ratios of B and C are respectively 0.9 and 0.8.

As can be seen from FIG. 5, the inclination of the curves "B" and "C" is considerably steeper than that of the curve "A". This aspect is also shown by the fact that the grain size ranges "b" and "c", relating to grains distributed both in the fine and the coarse fraction, are considerably smaller than "a" in the curve "A". Thus it will be appreciated that the clean gas band according to the invention provides a separator having significantly better separating capability.

I claim:

1. A method for separating particulate material into coarse and fine fractions each including a portion of an intermediate fraction comprising:

(a) suspending the material in a conveying gas flow;

(b) directing the conveying gas suspension in a radially symmetrical flow pattern in a given direction;

(c) directing a band of clean gas in said direction so as to concentrically surround the gas suspension with a band of clean gas containing substantially no particulate so as to contain the fine and fine-intermediate fractions, in the suspension gas, said band of clean gas having substantially the same velocity as the gas suspension;

(d) directing the conveying gas flow and said band of clean gas past a vaned rotating rotor having an axis of rotation axially aligned with the concentric axis of the gases;

(e) flinging the coarse and coarse-intermediate fractions in a radially outward direction by action of the vaned rotor; and (f) directing the remaining fine and fine-intermediate fractions in the gas flow past the rotor for subsequent separation from the gas.

2. A method for separating particulate material into coarse and fine fractions in a separator having a rotationally symmetrical wall and a vaned rotor rotatable inside the wall about the axis of symmetry, comprising:

(a) suspending the material in a conveying gas flow;

(b) directing the conveying gas suspension through the separator in a radially symmetrical flow pattern in a given direction;

(c) directing a band of clean gas in said direction so as to concentrically surround the gas suspension with a band of clean gas containing substantially no particulate so as to bar the fine fraction from reaching the separator wall, said band of clean gas having substantially the same velocity as the gas suspension;

(d) directing the conveying gas flow and said band of clean gas past said vaned rotating rotor having an axis of rotation axially aligned with the concentric axis of the gases;

(e) flinging the coarse and coarse-intermediate fractions in a radially outward direction with the rotor vanes; and (f) directing the remaining fine and fine-intermediate fractions in the gas flow past the rotor for subsequent separation from the gas.

3. A method of sorting a particulate material into a coarse and fine fraction, in a separator having a rotationally symmetrical wall, a vaned rotor rotatable inside the wall about the axis of symmetry, and means for supplying the material-gas suspension and clean gas containing substantially no particulate from outside of said separator, in which the material is suspended in a gas flow and is conveyed past the rotor, by means of which the coarser fraction of the material is flung outwards towards the wall, the finer fraction of the material remaining entrained in the conveying gas to be subsequently separated from the gas, characterized in that a band of clean gas extending annularly around the suspension gas flow is provided inside and along the wall of the separator with substantially the same velocity as the gas suspension.

4. An apparatus for sorting particulate material containing coarse, intermediate and fine fractions suspended within a conveying gas flow into coarse and fine fractions each including a portion of the intermediate fraction comprising:

(a) a rotationally symmetrical wall for flow of conveying gas suspension therethrough;

(b) a vaned rotatable rotor axially aligned inside the wall for flinging the material in a radially outwardly direction;

(c) first means for supplying a material-gas suspension from outside of said rotationally symmetrical wall;

(d) second means for supplying a clean gas containing substantially no particulate from outside from said wall;

(e) first wall means to define a conduit coupled to said first supply means for passage of the material-gas suspension; and (f) second wall means defining with said first wall means an annular chamber within the wall in communication with said second supply means for providing a flow of an annular band of clean gas containing substantially no particulate inside and along said wall concentrically with the conveying gas suspension such that the conveying gas suspension and said band of clean gas have substantially the same velocity, the clean gas band restricting the suspension gas flow so as to bar the fine-intermediate fraction from reaching said wall and thereby increase the separation sharpness.

5. The apparatus according to claim 4 wherein the first wall means comprises:

(a) an inlet pipe at the bottom portion thereof for flow of conveying gas suspension therethrough, said inlet pipe defining the annular chamber coaxial with the apparatus through which clean gas can be passed to provide the annular band of clean conveying gas around said rotor.

6. An apparatus for sorting particulate material into coarse and fine fractions, said appararus being in communication with a supply of material-gas suspension and clean gas containing substantially no particulate from outside of said apparatus, comprising, a rotationally symmetrical wall, first means for supplying a material-gas suspension from outside of said rotationally symmetrical wall, second means for supplying a clean gas containing substantially no particulate from outside of said wall, first wall means to define a conduit coupled to said first supply means for passage of the material-gas suspension, and a vaned rotor rotatable inside the wall about the axis of symmetry, in which the material is suspended in a gas flow and is conveyed past the rotor, by means of which the coarser fraction of the material is flung radially outwardly towards the wall, the finer fraction of the material remaining suspended in the conveying gas to be subsequently separated from the gas, and second wall means defining with said first wall means an annular chamber coaxial with the wall in communication with said second supply means through which the clean gas having the same velocity as the conveying gas can be passed for providing an annular band of clean conveying gas around the rotor so as to bar the finer fraction from reaching the wall and thereby increase the separation sharpness.

7. The apparatus according to claim 6, further comprising an inlet in its bottom for admission of unsorted material suspended in the conveying gas.

8. The apparatus according to claim 7 further comprising a fan rotatable coaxially with the apparatus wall for providing the ascending conveying gas flow having unsorted material therein.

* * * * *